US012698176B2

(12) United States Patent
Yang et al.

(10) Patent No.: US 12,698,176 B2
(45) Date of Patent: Aug. 4, 2026

(54) PIN WHEEL AND TERMINAL MATERIAL STRIP CONVEYING DEVICE

(71) Applicants: TE Connectivity Solutions GmbH, Schaffhausen (CH); Tyco Electronics (Shanghai) Co., Ltd., Shanghai (CN)

(72) Inventors: An (Joshua) Yang, Shanghai (CN); Lvhai (Samuel) Hu, Shanghai (CN); Roberto Francisco-Yi Lu, Bellevue, WA (US)

(73) Assignees: TE Connectivity Solutions GmbH, Schaffhausen (CH); Tyco Electronics (Shanghai) Co., Ltd., Shanghai (CN)

( * ) Notice: Subject to any disclaimer, the term of this patent is extended or adjusted under 35 U.S.C. 154(b) by 159 days.

(21) Appl. No.: 18/413,259

(22) Filed: Jan. 16, 2024

(65) Prior Publication Data

US 2024/0239627 A1 Jul. 18, 2024

(30) Foreign Application Priority Data

Jan. 17, 2023 (CN) ..... 202310079898.5

(51) Int. Cl.
*B65H 20/22* (2006.01)
*B65H 20/20* (2006.01)
*B65H 27/00* (2006.01)

(52) U.S. Cl.
CPC ..... *B65H 20/22* (2013.01); *B65H 27/00* (2013.01)

(58) Field of Classification Search
CPC ..... B65H 20/20; B65H 20/22; B65H 27/00; B41J 11/28; B65B 57/04; Y01T 83/658; H05K 13/0419

(Continued)

(56) References Cited

U.S. PATENT DOCUMENTS 2,012,289 A * 8/1935 Sherman ..... B41J 11/27 400/616
2,102,651 A * 12/1937 Dybvig ..... B41J 11/27 400/616.3

(Continued)

FOREIGN PATENT DOCUMENTS

CN 101408490 A 4/2009
FR 2925037 A1 * 6/2009 ..... B65H 27/00

OTHER PUBLICATIONS

Chinese Office Action dated May 28, 2026 with English translation, corresponding to Application No. 202310079898.5, 12 pages.

*Primary Examiner* — Victoria P Augustine
*Assistant Examiner* — Katelynne R Burrell
(74) *Attorney, Agent, or Firm* — Barley Snyder

(57) ABSTRACT

A pin wheel includes an outer wheel having an inner cavity extending through the outer wheel along an axial direction and a plurality of radial through-holes communicated with the inner cavity, an inner wheel assembled in the inner cavity to rotate together with the outer wheel, a plurality of pins respectively and movably installed in the radial through-holes, and a plurality of springs making the pins floatable in the radial through-holes. A first end of each of the pins extends out of one of the radial through-holes to engage with a positioning hole of a terminal material strip. A plurality of grooves are formed on an outer peripheral surface of the inner wheel. The grooves of the inner wheel respectively correspond to a second end of each of the pins to allow the second ends of the pins to each enter one of the grooves.

20 Claims, 8 Drawing Sheets

(58) Field of Classification Search
USPC ..... 226/87, 81, 76
See application file for complete search history.

(56) References Cited

U.S. PATENT DOCUMENTS 2,112,833 A * 4/1938 Dybvig ..... B41J 11/27 400/616
2,432,967 A * 12/1947 Johnson ..... B41J 11/27 400/616.3
2,476,326 A * 7/1949 Sherman ..... B41L 1/00 83/423
2,599,648 A * 6/1952 Lanegan ..... B41J 11/27 400/616.3
2,663,196 A * 12/1953 Davidson ..... F16H 7/18 226/81
2,724,279 A * 11/1955 Davidson ..... B41J 11/27 226/81
2,724,280 A * 11/1955 Davidson ..... B41L 5/06 226/81
2,806,691 A * 9/1957 Kalin ..... G03B 1/42 226/190
2,815,672 A * 12/1957 Storer ..... B41J 11/28 400/616.3
2,913,093 A * 11/1959 Bevan ..... B41J 11/27 400/616.3
3,410,469 A * 11/1968 Reinhard ..... B41J 11/27 474/163
4,022,365 A * 5/1977 Weller ..... B41J 11/27 226/87
4,033,493 A * 7/1977 Levinson ..... B65H 20/20 400/616.3
4,036,420 A * 7/1977 Lockwood ..... B65H 20/20 226/87
4,133,613 A * 1/1979 Webster ..... B41J 11/27 400/621
4,136,809 A * 1/1979 Engelmann ..... B41J 11/27 226/87
4,162,032 A * 7/1979 Lockwood ..... B65H 20/20 226/87
4,179,109 A * 12/1979 Harris ..... B41F 13/54 270/52.08
4,571,104 A * 2/1986 Jung ..... B41J 11/27 226/76
4,865,478 A * 9/1989 Chan ..... B41J 11/28 226/76
5,188,270 A * 2/1993 Hiramatsu ..... B65H 20/20 226/76
5,405,069 A * 4/1995 Duncan ..... B65H 20/22 226/25
6,032,845 A * 3/2000 Piccone ..... H05K 13/0419 226/139
2010/0306988 A1* 12/2010 Ziegler ..... B65H 20/22 294/94
2023/0156990 A1* 5/2023 Isobata ..... H05K 13/02 414/416.01

* cited by examiner

PIN WHEEL AND TERMINAL MATERIAL STRIP CONVEYING DEVICE

CROSS-REFERENCE TO RELATED APPLICATIONS

This application claims the benefit of the filing date under 35 U.S.C. § 119(a)-(d) of Chinese Patent Application No. 202310079898.5, filed on Jan. 17, 2023.

FIELD OF THE INVENTION

The present invention relates to a pin wheel, in particular to a pin wheel used for conveying a terminal material strip. In addition, the present invention also relates to a terminal material strip conveying device including the pin wheel.

BACKGROUND

In the prior art, a ratchet wheel is usually used to transport a terminal material strip. When the ratchet wheel rotates, the teeth on the ratchet wheel engage with the positioning holes on the terminal material strip to drive the terminal material strip forward. To ensure that the teeth on the ratchet wheel are engaged with the positioning holes on the terminal material strip, the pitch between the positioning holes on the terminal material strip must be consistent. However, sometimes the transported terminal material strips include multiple terminal material strips connected from end to end. At this point, it is difficult to accurately ensure that the pitch between adjacent positioning holes is equal to the predetermined pitch at the connection of the terminal material strips. Once the pitch between adjacent positioning holes is not equal to the predetermined pitch, it will cause the teeth on the ratchet wheel to not enter the positioning hole on the terminal material strip, but directly abut the surface of the terminal material strip, which causes damage to the terminal material strip and the ratchet wheel.

SUMMARY

A pin wheel includes an outer wheel having an inner cavity extending through the outer wheel along an axial direction and a plurality of radial through-holes communicated with the inner cavity, an inner wheel assembled in the inner cavity to rotate together with the outer wheel, a plurality of pins respectively and movably installed in the radial through-holes, and a plurality of springs making the pins floatable in the radial through-holes. A first end of each of the pins extends out of one of the radial through-holes to engage with a positioning hole of a terminal material strip. A plurality of grooves are formed on an outer peripheral surface of the inner wheel. The grooves of the inner wheel respectively correspond to a second end of each of the pins to allow the second ends of the pins to each enter one of the grooves.

BRIEF DESCRIPTION OF THE DRAWINGS

Features of the present invention will become more apparent by describing in detail exemplary embodiments thereof with reference to the accompanying drawings, in which.

DETAILED DESCRIPTION OF EXEMPLARY EMBODIMENTS

Figure 1:
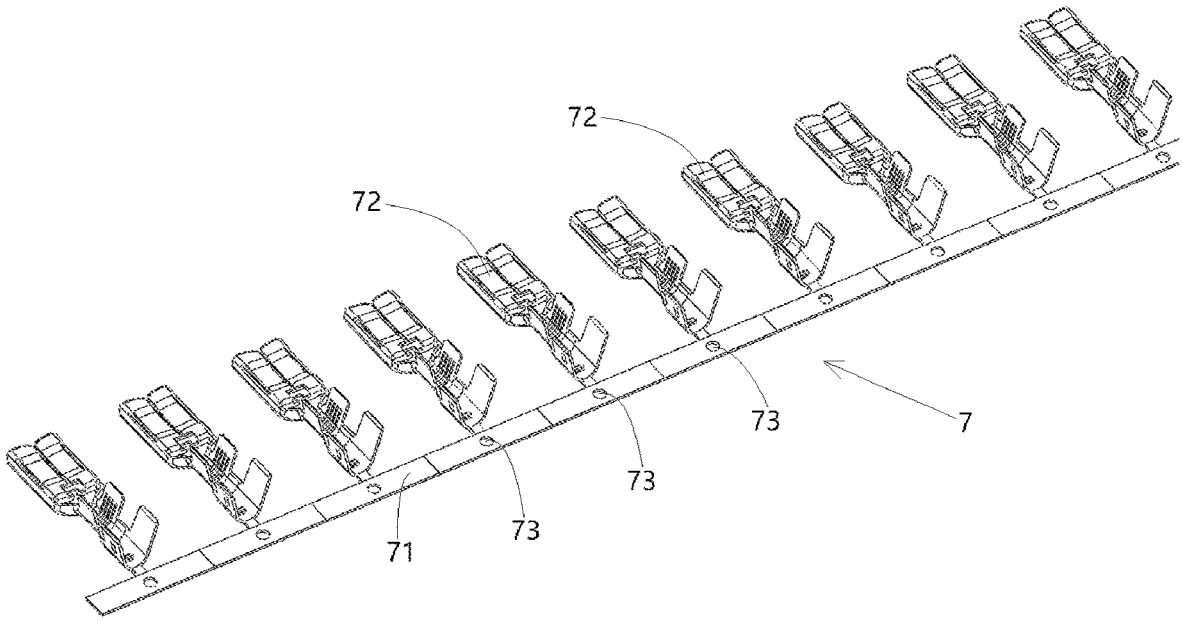
FIG. 1 shows an illustrative view of a terminal material strip according to an exemplary embodiment of the present invention.

Exemplary embodiments of the present disclosure will be described hereinafter in detail with reference to the attached drawings, wherein like reference numerals refer to like elements. The present disclosure may however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 shows an illustrative view of a terminal material strip 7 according to an exemplary embodiment of the present invention. As shown in FIG. 1, in the illustrated embodiment, the terminal material strip 7 typically includes a strip part 71 and multiple stamped terminals 72. The terminals 72 are connected to the side of the strip part 71. Multiple positioning holes 73 are formed in the strip part 71.

As shown in FIGS. 1 to 7, in an exemplary embodiment of the present invention, a pin wheel is disclosed. This pin wheel is used to transport the terminal material strip 7 shown in FIG. 1. In the illustrated embodiment, the pin wheel includes: an outer wheel 1, an inner wheel 2, a plurality of pins 3, and a plurality of springs 4. An inner cavity 101 is formed in the outer wheel 1 that runs through the outer wheel 1 along an axial direction of the outer wheel 1. A plurality of radial through-holes 102 communicated with the inner cavity 101 are formed in the outer wheel 1. The inner wheel 2 is assembled in the inner cavity 101 of the outer wheel 1 to rotate together with the outer wheel 1. The pins 3 are respectively and movably installed in the radial through-holes 102 of outer wheel 1. The springs 4 are respectively arranged in the radial through-holes 102 of outer wheel 1 to support the pin 3 floatable in the radial through-hole 102, enabling the pin 3 to float along the radial direction of the pin wheel in the radial through-hole 102. When the pin 3 abuts against the surface of the terminal material strip 7, the pin 3 will be moved towards and enters the groove 20 on the inner wheel 2 under the push of the terminal material strip 7, thereby preventing damage to the terminal material strip 7 and pin wheel.

Figure 5:
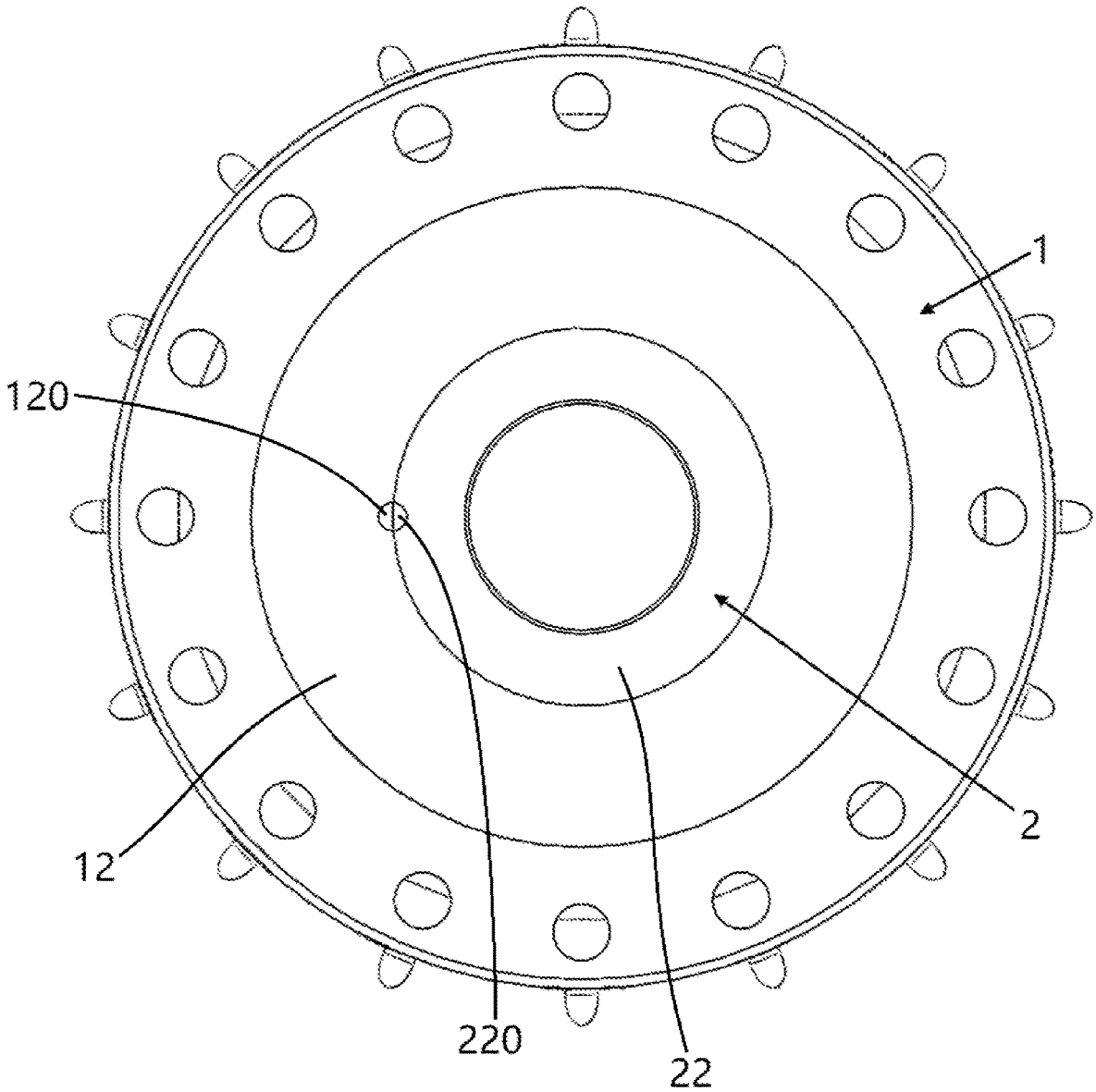
FIG. 5 shows an illustrative plan view of the pin wheel according to an exemplary embodiment of the present invention when viewed from the rear.
Figure 6:
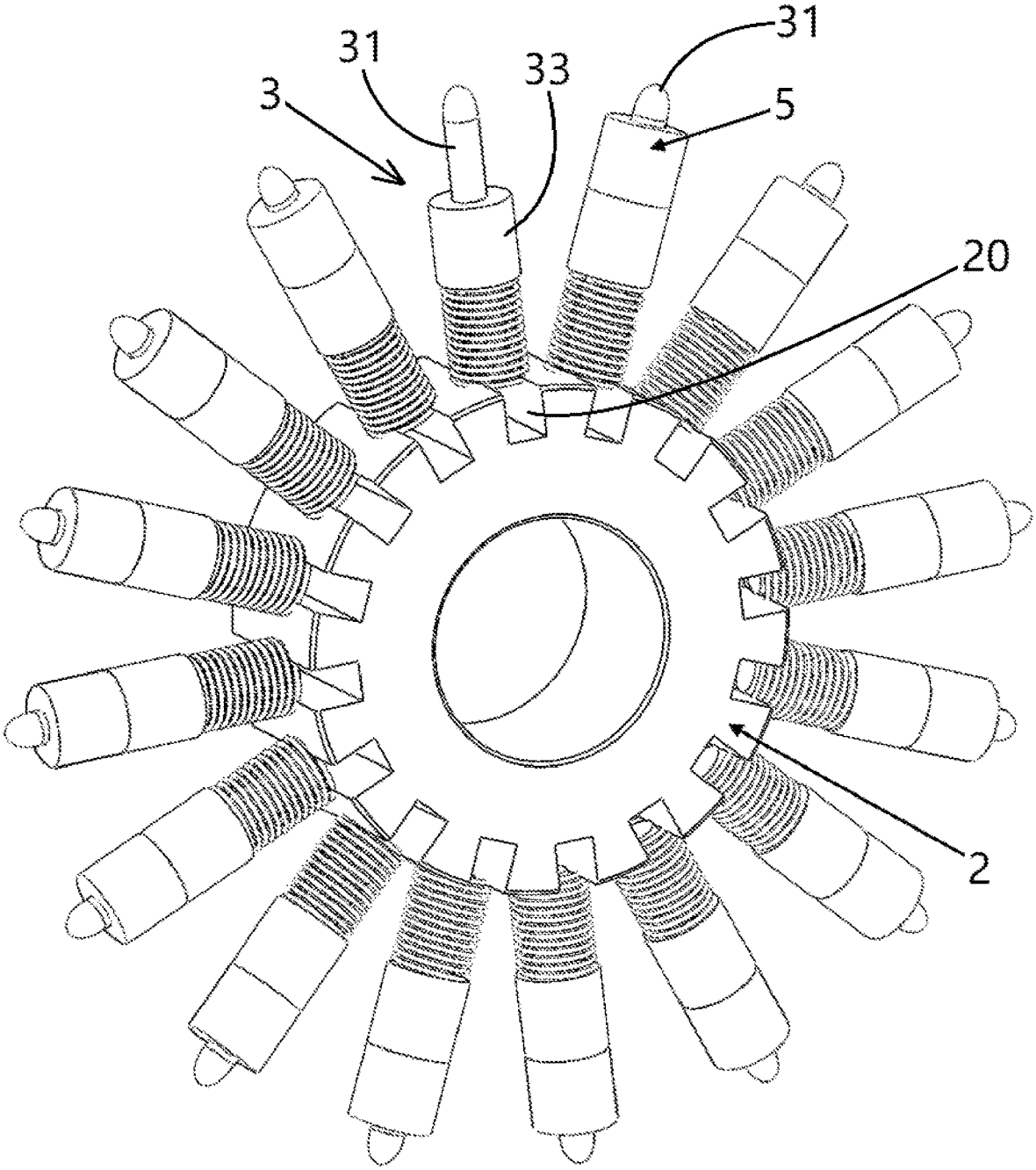
FIG. 6 shows an illustrative perspective view of a pin wheel according to an exemplary embodiment of the present invention, wherein the outer wheel is removed.
Figure 7:
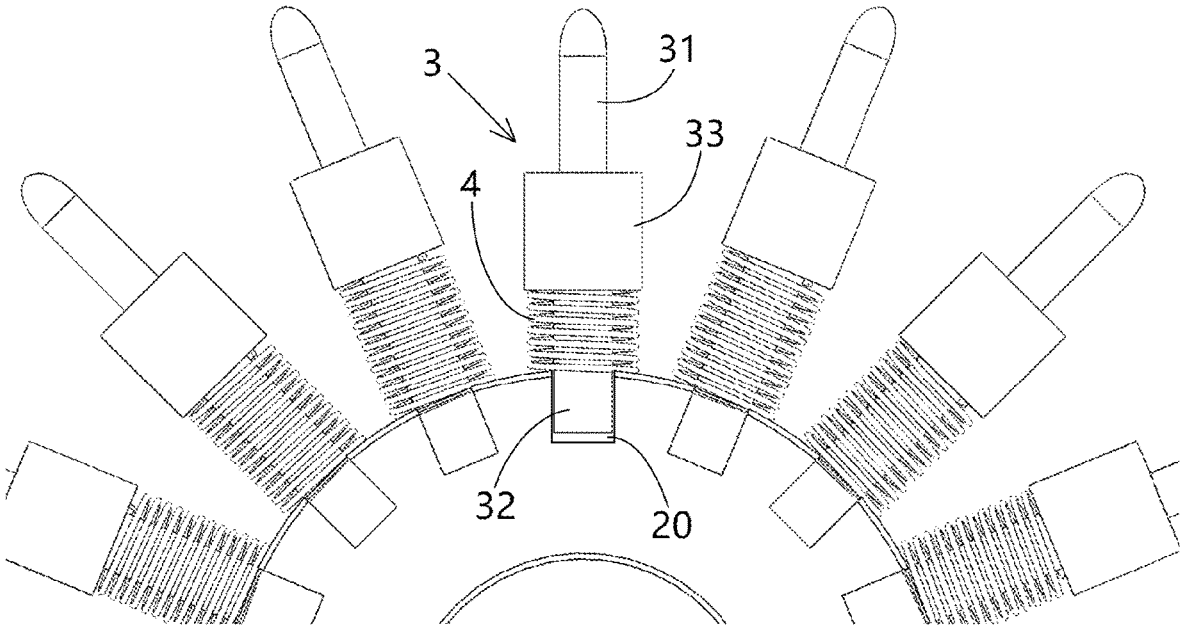
FIG. 7 shows an illustrative view of a pin, a spring, and an inner wheel of a pin wheel according to an exemplary embodiment of the present invention, wherein one pin moves into a groove of the inner wheel.

As shown in FIGS. 1 to 7, in the illustrated embodiments, multiple radial through holes 102 are uniformly spaced in the circumferential direction of the outer wheel 1, and the radial through holes 102 have outer openings located on the outer circumferential surface of the outer wheel 1. One end 31 of pin 3 extends out from the outer opening of the radial through-hole 102 to engage with the positioning hole 73 on terminal material strip 7. The terminal material strip 7 may be driven forward when the pin wheel is rotated. A plurality of grooves 20 are formed on the outer peripheral surface of inner wheel 2, respectively corresponding to the other end 32 of multiple pins 3 to allow the other end 32 of pin 3 to enter the groove 20, as shown in FIGS. 6 and 7. The end 31 of the pins 3 may be referred to as a first end 31 and the end 32 of the pins 3 may be referred to as a second end 32.

When one end 31 of pin 3 enters the positioning hole 73 of terminal material strip 7, the other end 32 of pin 3 is in an initial position that does not enter the groove 20. When one end 31 of pin 3 does not enter the positioning hole 73 of terminal material strip 7 and is pressed against the surface of terminal material strip 7, the pin 3 is moved towards groove 20 against the elastic force of spring 4 under the pushing force of terminal material strip 7, causing the other end 32 of pin 3 to enter groove 20. Therefore, it is possible to determine whether pin 3 enters the positioning hole 73 of terminal material strip 7 based on whether the other end 32 of pin 3 enters the groove 20.

As shown in FIGS. 6 and 7, in the illustrated embodiment, the pin 3 has a radially convex positioning part 33 located between its two ends 31 and 32. One end of spring 4 is against the positioning part 33 of pin 3, and the other end is against the outer peripheral surface of inner wheel 2, so that the pin 3 is floatable and supported in the radial through-hole 102.

Figure 8:
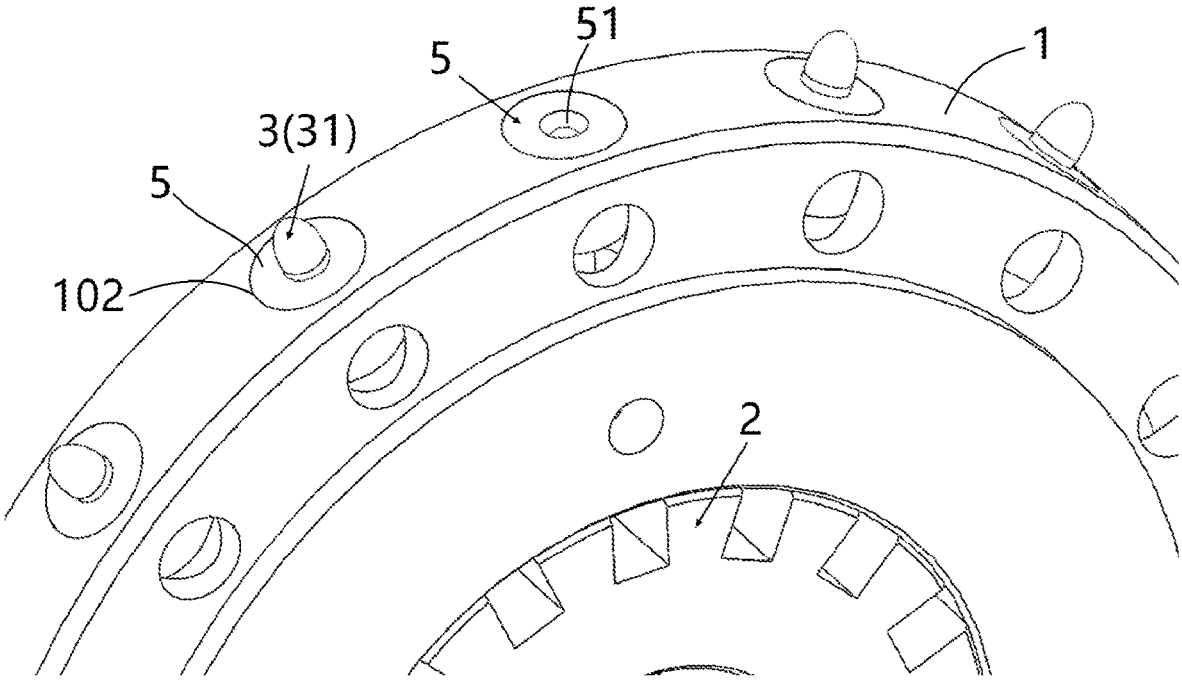
FIG. 8 shows an illustrative partial enlarged view of a pin wheel according to an exemplary embodiment of the present invention.

As shown in FIGS. 6 and 8, in the illustrated embodiment, the pin wheel further includes a plurality of limit bushings 5, which are respectively embedded in the outer openings of multiple radial through-holes 102. A pin hole 51 is formed in the limit bushing 5 that allows one end 31 of pin 3 to pass through. The limit bushing 5 is used to rest or abut against the positioning part 33 of the pin 3 to prevent the pin 3 from detaching from the outer opening of the radial through-hole 102.

Figure 3:
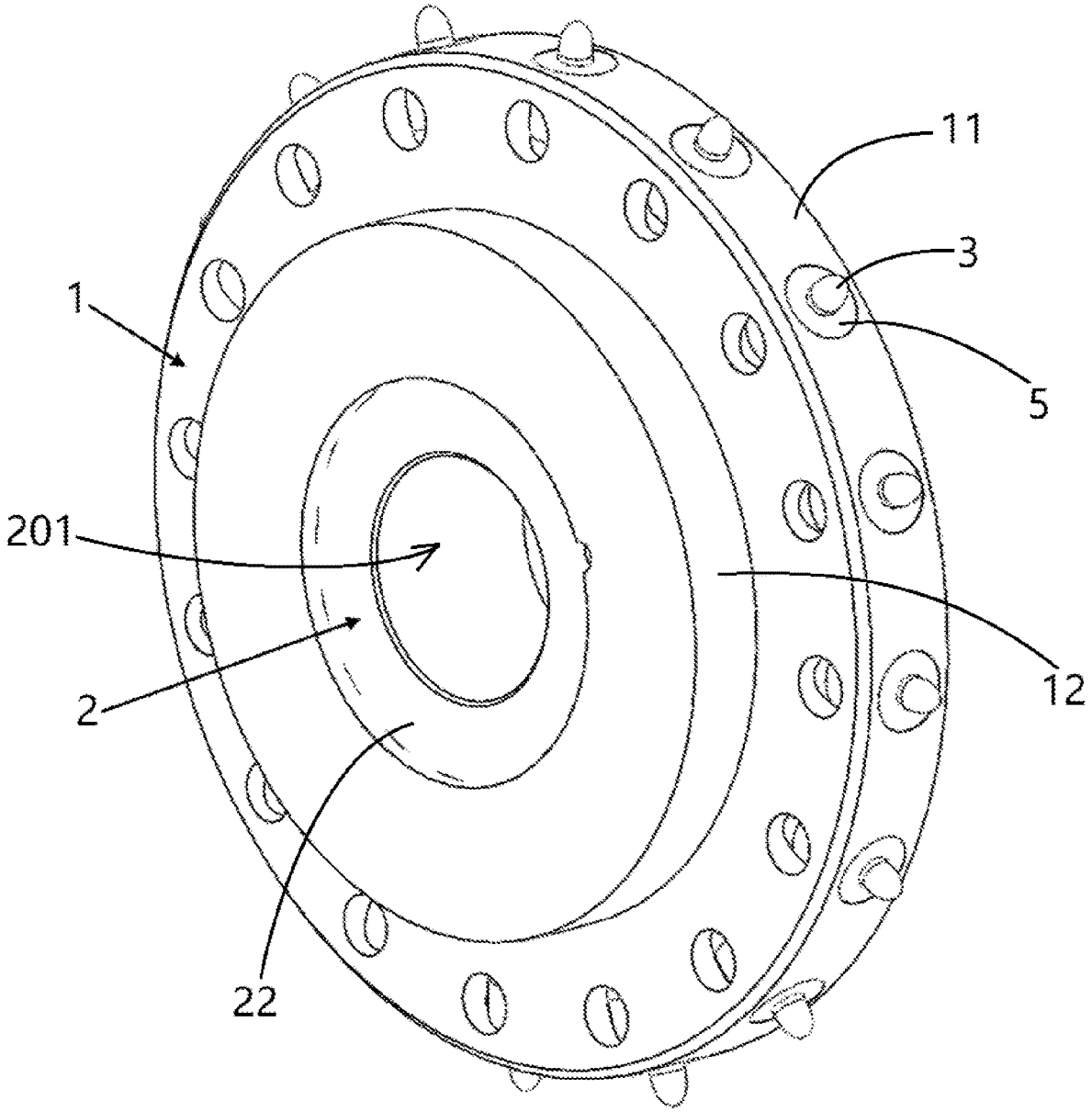
FIG. 3 shows an illustrative perspective view of a pin wheel according to an exemplary embodiment of the present invention when viewed from the rear.
Figure 4:
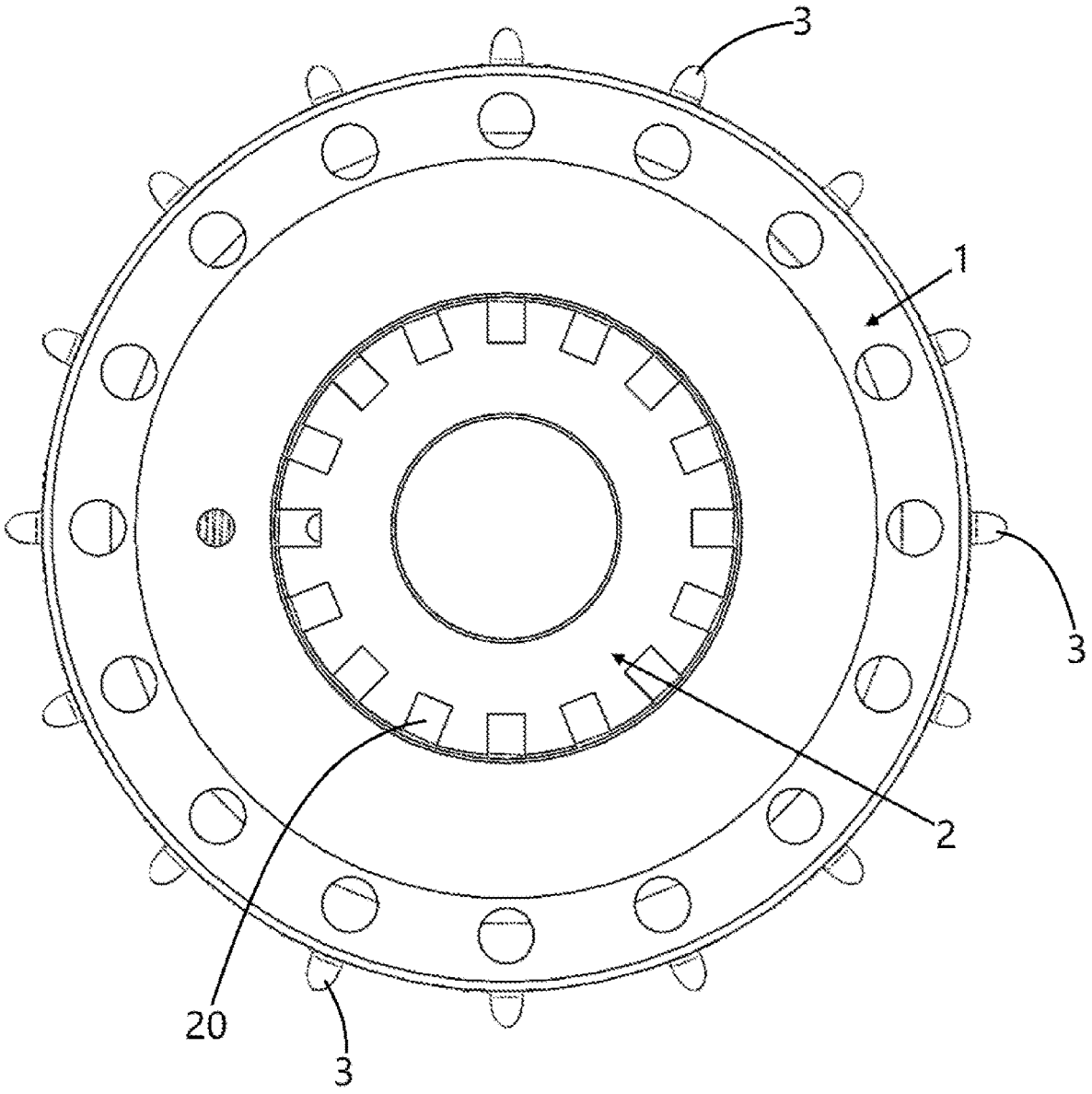
FIG. 4 shows an illustrative plan view of a pin wheel according to an exemplary embodiment of the present invention when viewed from the front side.

As shown in FIG. 3, in the illustrated embodiment, the outer wheel 1 includes a first outer wheel part 11 and a second outer wheel part 12 that are coaxially connected, and the diameter of the first outer wheel part 11 is greater than that of the second outer wheel part 12. The inner cavity 101 axially runs through the first outer wheel part 11 and the second outer wheel part 12, and multiple radial through-holes 102 are formed in the first outer wheel part 11.

Figure 2:
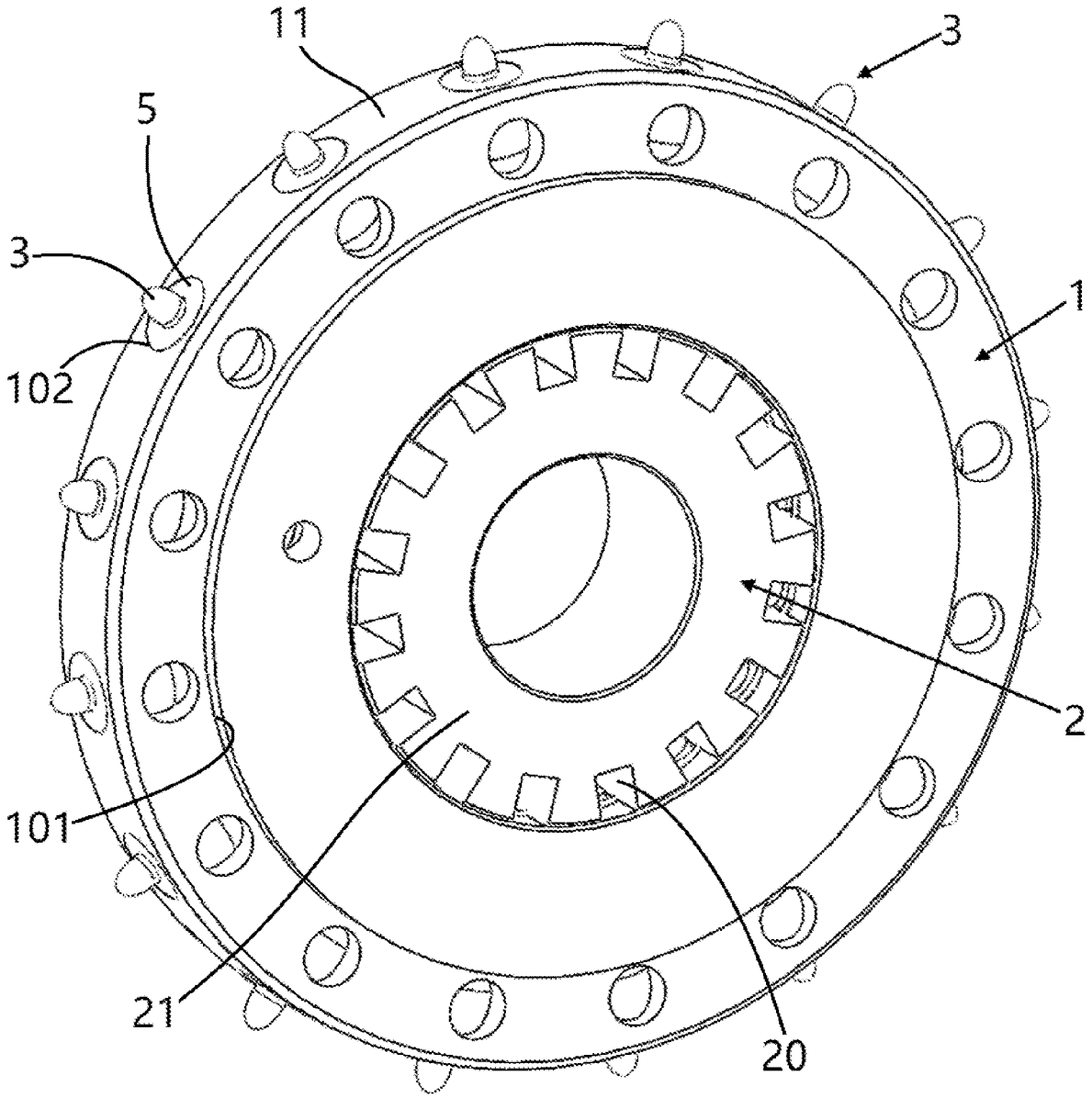
FIG. 2 shows an illustrative perspective view of a pin wheel according to an exemplary embodiment of the present invention when viewed from the front side.

As shown in FIGS. 2 and 3, in the illustrated embodiment, the inner wheel 2 includes a first inner wheel part 21 and a second inner wheel part 22 that are coaxially connected, and the diameter of the first inner wheel part 21 is greater than that of the second inner wheel part 22. The first inner wheel part 21 and the second inner wheel part 22 are respectively installed in the first outer wheel part 11 and the second outer wheel part 12, and multiple grooves 20 are formed on the outer peripheral surface of the first inner wheel part 21.

As shown in FIG. 2, in the illustrated embodiments, the groove 20 axially runs through the first inner wheel part 21, allowing for viewing from the axial side of the first inner wheel part 21 to determine whether the other end 32 of the pin 3 enters the groove 20.

As shown in FIG. 5, in the illustrated embodiments, a first half circular keyway 120 is formed on the inner peripheral surface of the second outer wheel part 12, and a second half circular keyway 220 corresponding to the first half circular keyway 120 is formed on the outer peripheral surface of the second inner wheel part 22. The pin wheel also includes a cylindrical engagement key, which is inserted into a circular keyway composed of the first half circular keyway 120 and the second half circular keyway 220 to circumferentially engage the outer wheel 1 and the inner wheel 2.

However, the present invention is not limited to the illustrated embodiments. For example, in another exemplary embodiment of the present invention, a keyway is formed on one of the inner peripheral surface of the second outer wheel part 12 and the outer peripheral surface of the second inner wheel part 22, and an engagement key is formed on the other. The engagement key engages with the keyway to circumferentially engage the outer wheel 1 and inner wheel 2.

As shown in FIG. 3, in the illustrated embodiments, a central shaft hole 201 is formed in the inner wheel 2 for installing a drive shaft, enabling the outer wheel 1 and inner wheel 2 of the pin wheel to rotate together under the drive of the drive shaft.

In an embodiment, the manufacturing material of pin 3 is different from that of outer wheel 1 and inner wheel 2. The hardness and wear resistance of the pin 3 should be higher than that of outer wheel 1 and inner wheel 2. This can reduce the cost of outer wheel 1 and inner wheel 2.

As shown in FIGS. 1 to 8, in the illustrated embodiments, the outer wheel 1, the inner wheel 2, the pin 3, and the spring 4 of the pin wheel are assembled together in a detachable manner. Therefore, it is convenient to replace any of the outer wheel 1, the inner wheel 2, the pin 3, and the spring 4.

In another exemplary embodiment of the present invention, a terminal material strip conveying device is also disclosed. The terminal material strip conveying device includes the aforementioned pin wheel and a driving device. The driving device is connected to the inner wheel 2 of the pin wheel, which is used to drive the outer wheel 1 and inner wheel 2 of the pin wheel to rotate together. The driving device includes a servo motor, and the drive shaft of the servo motor is installed in the center shaft hole 201 of the inner wheel 2 to drive the outer wheel 1 and inner wheel 2 of the pin wheel to rotate together.

The terminal material strip conveying device may also include a detection device, which is used to detect whether the other end 32 of the pin 3 of the pin wheel enters the groove 20 on the inner wheel 2. The detection device may include a camera and a judgment device. The camera is used to capture an image of the pin wheel. The judgment device is used to determine whether the other end 32 of pin 3 enters the groove 20 on inner wheel 2 based on the captured image.

In an embodiment, the terminal material strip conveying device also includes a control device, which is used to immediately stop the driving device when the detection device detects that the other end 32 of pin 3 enters the groove 20 on the inner wheel 2 to prevent damage to the terminal material strip 7 or pin wheel. After the driving device stops, the terminal material strip 7 can be manually adjusted to allow the pin 3 to re-enter the positioning hole 73 on the terminal material strip 7, so that the terminal material strip 7 can continue to be transported through the pin wheel.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A pin wheel for conveying a terminal material strip, comprising:

an outer wheel having an inner cavity extending through the outer wheel along an axial direction and a plurality of radial through-holes communicated with the inner cavity, the radial through-holes are evenly spaced in a circumferential direction of the outer wheel and each have an outer opening on an outer peripheral surface of the outer wheel, the outer wheel further including a first outer wheel part and a second outer wheel part that are coaxially connected, a diameter of the first outer wheel part is greater than a diameter of the second outer wheel part, the inner cavity runs axially through the first outer wheel part and the second outer wheel part, the radial through-holes are formed in the first outer wheel part;

an inner wheel assembled in the inner cavity to rotate together with the outer wheel, a plurality of grooves are formed on an outer peripheral surface of the inner wheel;

a plurality of pins respectively and movably installed in the radial through-holes, a first end of each of the pins extends out of the outer opening of one of the radial through-holes to engage with a positioning hole of the terminal material strip and drive the terminal material strip forward when the pin wheel is rotated, the grooves of the inner wheel respectively correspond to a second end of each of the pins to allow the second ends of the pins to each enter one of the grooves; and a plurality of springs respectively arranged in the radial through-holes, the springs making the pins floatable in the radial through-holes.

2. The pin wheel of claim 1, wherein, when the first end of the pin enters the positioning hole, the second end of the pin is in an initial position that has not entered the groove.

3. The pin wheel of claim 2, wherein, when the first end of the pin is pressed against a surface of the terminal material strip, the pin is moved toward the groove under a push of the terminal material strip, and the second end of the pin enters the groove.

4. The pin wheel of claim 1, wherein the pin has a radially convex positioning part between the first end and the second end, one end of the spring is against the radially convex positioning part and another end of the spring is against the outer peripheral surface of the inner wheel.

5. The pin wheel of claim 4, further comprising a plurality of limit bushings respectively embedded in the outer openings of the radial through-holes, the limit bushings having a pin hole receiving the first end of the pin.

6. The pin wheel of claim 5, wherein the limit bushings abut the radially convex positioning part of the pins and prevent the pins from detaching from the radial through-holes.

7. The pin wheel of claim 1, wherein the inner wheel includes a first inner wheel part and a second inner wheel part that are coaxially connected, a diameter of the first inner wheel part is greater than a diameter of the second inner wheel part, the first inner wheel part and the second inner wheel part are respectively installed in the first outer wheel part and the second outer wheel part, the grooves are formed on the outer peripheral surface of the first inner wheel part.

8. The pin wheel of claim 7, wherein a first half circular keyway is formed on an inner peripheral surface of the second outer wheel part, and a second half circular keyway corresponding to the first half circular keyway is formed on an outer peripheral surface of the second inner wheel part.

9. The pin wheel of claim 8, further comprising a circular keyway composed of the first half circular keyway and the second half circular keyway formed in the outer wheel and the inner wheel.

10. The pin wheel of claim 7, wherein each of the grooves runs axially through the first inner wheel part, making visible from an axial side of the first inner wheel part whether the second end of the pin enters the groove.

11. The pin wheel of claim 7, wherein a keyway is formed on one of an inner circumferential surface of the second outer wheel part and an outer circumferential surface of the second inner wheel part.

12. The pin wheel of claim 1, wherein a central shaft hole is formed in the inner wheel, the central shaft hole receives a drive shaft, enabling the outer wheel and inner wheel of the pin wheel to rotate together under a drive of the drive shaft.

13. The pin wheel of claim 1, wherein a hardness and wear resistance of the pins are higher than a hardness and wear resistance of the outer wheel and the inner wheel.

14. The pin wheel of claim 1, wherein the outer wheel, the inner wheel, the pins, and the springs are assembled together in a detachable manner.

15. A terminal material strip conveying device, comprising:

a pin wheel including:

an outer wheel having an inner cavity extending through the outer wheel along an axial direction and a plurality of radial through-holes communicated with the inner cavity, the radial through-holes are evenly spaced in a circumferential direction of the outer wheel and each have an outer opening on an outer peripheral surface of the outer wheel, the outer wheel includes a first outer wheel part and a second outer wheel part that are coaxially connected, a diameter of the first outer wheel part is greater than a diameter of the second outer wheel part, the inner cavity runs axially through the first outer wheel part and the second outer wheel part, the radial through-holes are formed in the first outer wheel part;

an inner wheel assembled in the inner cavity to rotate together with the outer wheel, a plurality of grooves are formed on an outer peripheral surface of the inner wheel; and a plurality of pins respectively and movably installed in the radial through-holes, a first end of each of the pins extends out of the outer opening of one of the radial through-holes to engage with a positioning hole of a terminal material strip and drive the terminal material strip forward when the pin wheel is rotated, the grooves of the inner wheel respectively correspond to a second end of each of the pins to allow the second ends of the pins to each enter one of the grooves, wherein the inner wheel of the pin wheel is adapted to be connected to a driving device for driving the outer wheel and inner wheel of the pin wheel to rotate together.

16. The terminal material strip conveying device of claim 15, wherein the inner drive wheel includes a central shaft hole adapted to receive a drive shaft of the driving device.

17. A pin wheel for conveying a terminal material strip, comprising:

an outer wheel having an inner cavity extending through the outer wheel along an axial direction and a plurality of radial through-holes communicated with the inner cavity, the radial through-holes are evenly spaced in a circumferential direction of the outer wheel and each have an outer opening on an outer peripheral surface of the outer wheel;

an inner wheel assembled in the inner cavity to rotate together with the outer wheel, a plurality of grooves are formed on an outer peripheral surface of the inner wheel; and a plurality of pins respectively and movably installed in the radial through-holes, a first end of each of the pins extends out of the outer opening of one of the radial through-holes to engage with a positioning hole of the terminal material strip and drive the terminal material strip forward when the pin wheel is rotated, the grooves of the inner wheel respectively correspond to a second end of each of the pins to allow the second ends of the pins to each enter one of the grooves, the grooves extend axially through the first inner wheel part such that it is visible from an axial side of the first inner wheel part whether the second end of the pin enters the groove.

18. The pin wheel of claim 17, further comprising a plurality of springs respectively arranged in the radial through-holes, the springs making the pins floatable in the radial through-holes.

19. The pin wheel of claim 17, wherein the outer wheel includes a first outer wheel part and a second outer wheel part that are coaxially connected, a diameter of the first outer wheel part is greater than a diameter of the second outer wheel part.

20. The pin wheel of claim 19, wherein the inner cavity runs axially through the first outer wheel part and the second outer wheel part, the radial through-holes are formed in the first outer wheel part.

* * * * *